US008814717B2

(12) United States Patent
Yashiki

(10) Patent No.: US 8,814,717 B2
(45) Date of Patent: Aug. 26, 2014

(54) GOLF CLUB

(75) Inventor: Tatsuya Yashiki, Kobe (JP)

(73) Assignee: SRI Sports Limited, Kobe (JP)

( * ) Notice: Subject to any disclaimer, the term of this patent is extended or adjusted under 35 U.S.C. 154(b) by 79 days.

(21) Appl. No.: 13/339,636

(22) Filed: Dec. 29, 2011

(65) Prior Publication Data

US 2012/0172142 A1 Jul. 5, 2012

(30) Foreign Application Priority Data

Dec. 29, 2010 (JP) ..... 2010-294363

(51) Int. Cl.
*A63B 53/00* (2006.01)

(52) U.S. Cl.
USPC ..... 473/292

(58) Field of Classification Search
USPC ..... 473/292
See application file for complete search history.

(56) References Cited

U.S. PATENT DOCUMENTS

| | | | | |
|---|---|---|---|---|
| 5,746,664 | A * | 5/1998 | Reynolds, Jr. | 473/252 |
| 6,648,772 | B2 * | 11/2003 | Vincent et al. | 473/334 |
| 2004/0038762 | A1 | 2/2004 | Okamoto | |
| 2006/0063618 | A1 | 3/2006 | Okamoto | |
| 2006/0178229 | A1 | 8/2006 | Liang et al. | |
| 2011/0124431 | A1 | 5/2011 | Karube | |

FOREIGN PATENT DOCUMENTS

| | | | |
|---|---|---|---|
| JP | 64-9674 | U | 1/1989 |
| JP | 5-82454 | U | 11/1993 |
| JP | 6-39039 | U | 5/1994 |
| JP | 7-7666 | U | 2/1995 |
| JP | 3015394 | U | 6/1995 |
| JP | 10-071222 | A | 3/1998 |
| JP | 2001-252377 | A | 9/2001 |
| JP | 2006-141710 | A | 6/2006 |
| JP | 2006-212407 | A | 8/2006 |
| JP | 3142270 | U | 5/2008 |
| JP | 4507266 | B1 | 7/2010 |
| WO | WO 02/053236 | A1 | 7/2002 |

* cited by examiner

*Primary Examiner* — Michael Dennis
(74) *Attorney, Agent, or Firm* — Birch, Stewart, Kolasch & Birch, LLP

(57) ABSTRACT

A golf club 2 is provided with a head 4, a shaft 6, a grip 8, a head cavity body 10 mounted to the head, a grip cavity body 40 mounted to the grip 8, a head weight 12 attachable to/detachable from the head cavity body 10, and a grip weight 12 attachable to/detachable from the grip cavity body 40. A material of the grip cavity body is a polymer. A material of the head cavity body is a polymer. Preferably, the head weight 12 is attachable to/detachable from the grip cavity body 40. Preferably, the grip weight 12 is attachable to/detachable from the head cavity body 40. Preferably, in the golf club 2, a club mass can be adjusted without substantially changing a club balance.

11 Claims, 15 Drawing Sheets

GOLF CLUB

The present application claims priority on Patent Application No. 2010-294363 filed in JAPAN on Dec. 29, 2010, the entire contents of which are hereby incorporated by reference.

BACKGROUND OF THE INVENTION

1. Field of the Invention

The present invention relates to a golf club having a weight.

2. Description of the Related Art

A golf club having adjustability has been known. For example, a head in which a mass and position of a weight can be changed has been known. A position of a center of gravity of the head can be adjusted by the weight attached to the head. The weight attached to a sole can contribute to lowering of a center of gravity of the head. An increase in a head weight caused by the weight can improve rebound performance to a ball. A golf club in which a weight can be attached to a grip portion has been also known. The weight contributes to lightening of a club balance (swing weight). An increase in a club mass suppresses useless motions of hands and arms, and thereby the increase can contribute to improvement in a swing.

A golf club in which a weight is attached to a head is disclosed in Japanese Patent Application Laid-Open Nos. 2006-212407 (US2006/0178229) and 2006-141710. A golf club in which a weight is attached to a grip portion is disclosed in Japanese Patent No. 4507266 (US2011/0124431), International Publication WO2002-053236 (US2004/0038762, US2006/0063618), Japanese Patent Application Laid-Open Nos. 2001-252377 and 10-71222, and Japanese Utility Model Application Laid-Open Nos. 06-39039 and 05-82454. A vibration absorbing member having a weight is disclosed in Japanese Patent Application Laid-Open No. 10-71222.

SUMMARY OF THE INVENTION

The club balance may be changed by changing the position or the mass of the weight. The conventional technique cannot change a specification such as the club mass without changing the club balance. The conventional technique restrains a degree of freedom of adjustability.

It is an object of the present invention to provide a golf club having a high degree of freedom of adjustability.

A golf club according to the present invention includes a head, a shaft, a grip, a head cavity body mounted to the head, a grip cavity body mounted to the grip, a head weight attachable to/detachable from the head cavity body, and a grip weight attachable to/detachable from the grip cavity body. A material of the grip cavity body is a polymer. A material of the head cavity body is a polymer.

Preferably, the head weight is attachable to/detachable from the grip cavity body. Preferably, the grip weight is attachable to/detachable from the head cavity body.

Preferably, a club mass can be adjusted without substantially changing a club balance.

Preferably, the plurality of grip weights is attachable to/detachable from the grip cavity body.

Preferably, the head weight and the grip weight are attached/detached by the same tool.

Preferably, the head weight and the grip weight can be attached/detached by relative rotation of an angle θ.

The present invention can provide a golf club having a high degree of freedom of adjustability.

BRIEF DESCRIPTION OF THE DRAWINGS

FIG. 6 is a bottom view;

FIG. 15A to 15C shows a state where a weight is not attached.

DESCRIPTION OF THE PREFERRED EMBODIMENTS

Hereinafter, the present invention will be described in detail based on the preferred embodiments with appropriate references to the drawings.

In a golf club of the present invention, weight attaching/detaching mechanisms are provided on at least two portions. These mechanisms satisfy the Golf Rules defined by Royal and Ancient Golf Club of Saint Andrews (R&A). That is, the weight attaching/detaching mechanism in the present invention satisfies requirements specified in "1b Adjustability" in "1 Club" of "Appendix II Design of Club" defined by R&A. The requirements defined by the "1b Adjustability" are the following items (i), (ii), and (iii):

(i) the adjustment cannot be readily made;

(ii) all adjustable parts are firmly fixed and there is no reasonable likelihood of them working loose during a round; and (iii) all configurations of adjustment conform with the Rules.

Figure 1:
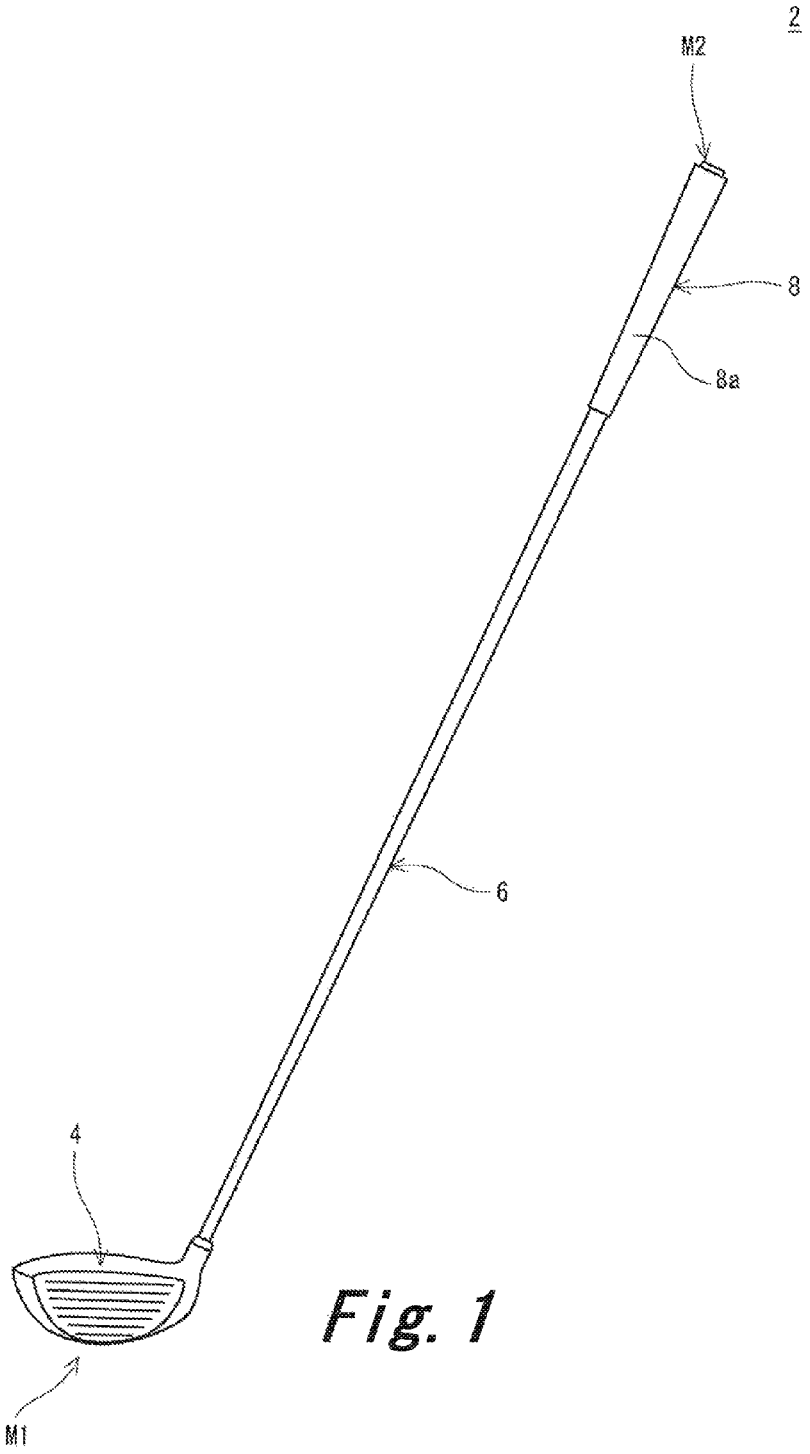
FIG. 1 is a front view showing a golf club according to one embodiment of the present invention.

A golf club 2 of FIG. 1 is provided with a head 4, a shaft 6, and a grip 8. The head 4 is mounted to one end part of the shaft 6. The grip 8 is mounted to the other end part of the shaft 6.

The head 4 is a wood type head. The head 4 is exemplary. A utility type head, a hybrid type head, an iron type head, and a putter type head may be used in place of the head 4. The shaft 6 is a tubular body. Examples of the shaft 6 include a steel shaft and a so-called carbon shaft.

The grip 8 has an approximately cylindrical shape. Although not shown in the drawings, grooves are formed in a holding surface 8*a* which is an outer peripheral surface of the grip 8. When a golf player swings the golf club 2, the golf player holds the holding surface 8*a*.

Although a material of the grip 8 is not particularly restricted, the material is preferably a rubber. For example, a natural rubber, a styrene-butadiene rubber, EPDM, an isoprene rubber, and a mixture thereof are preferable. However, as described later, two kinds of rubber compositions are used in the grip 8.

The golf club 2 has a head weight attaching/detaching mechanism M1 and a grip weight attaching/detaching mechanism M2. The head weight attaching/detaching mechanism M1 is provided in the head 4. The grip weight attaching/detaching mechanism M2 is provided in the grip 8. As shown in an embodiment to be described later, the grip weight attaching/detaching mechanism M2 may be provided in a butt end part of the shaft.

Figure 2:
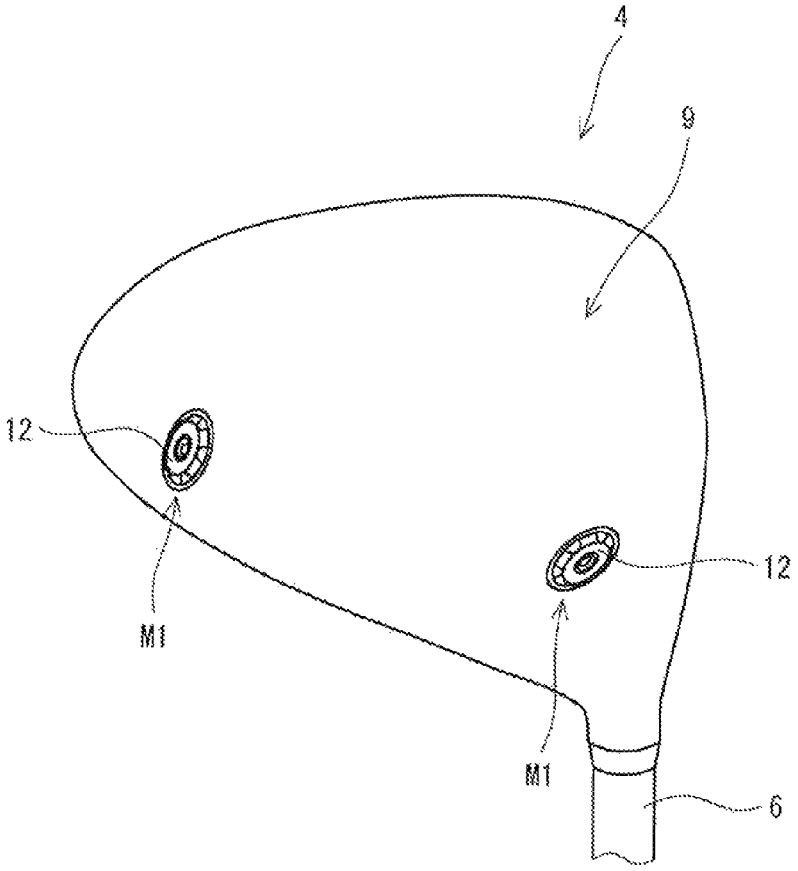
FIG. 2 is a perspective view of a vicinity of a sole of the golf club of FIG. 1.
Figure 3:
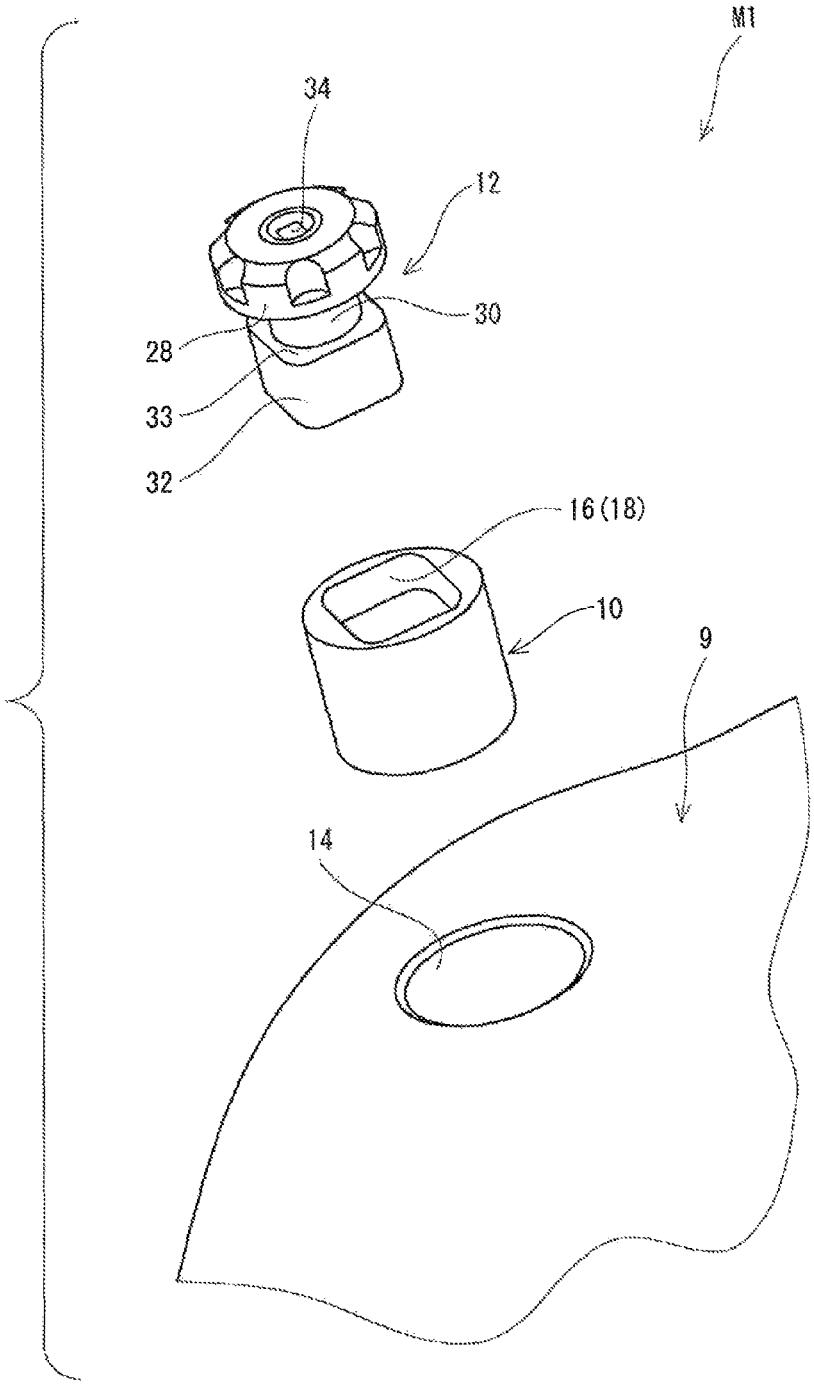
FIG. 3 is an exploded perspective view of a head weight attaching/detaching mechanism.

FIG. 2 is a perspective view of the golf club 2 as viewed from a sole 9 side of the head 4. FIG. 3 is an exploded perspective view of the head weight attaching/detaching mechanism M1. The head weight attaching/detaching mechanism M1 is provided with a head cavity body 10 and a weight 12. The head 4 is provided with a hole 14.

The cavity body 10 is fixed in the hole 14. The weight 12 is detachably mounted to the cavity body 10. Therefore, the weight 12 is attachable to/detachable from the head 4.

Figure 4:
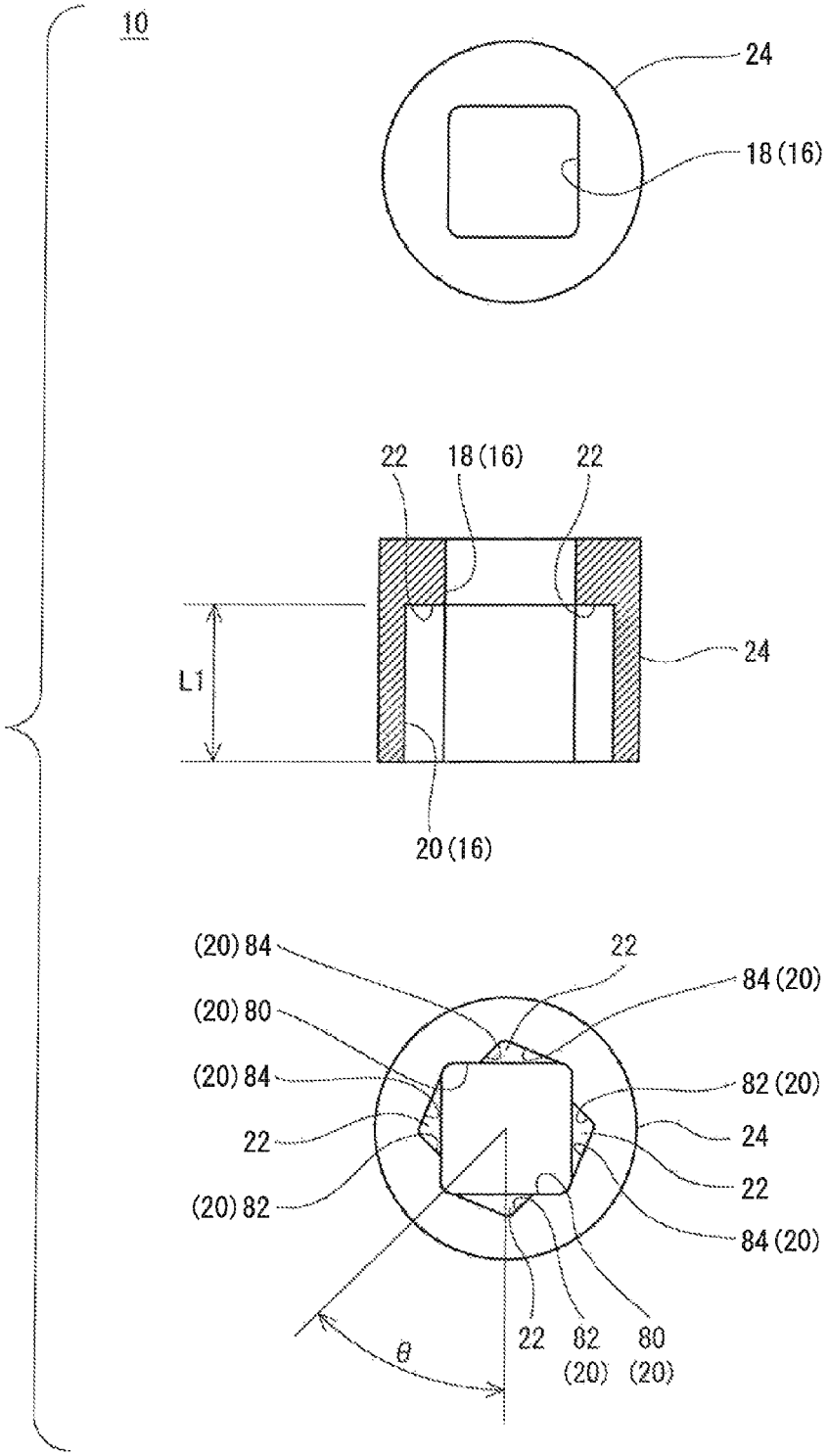
FIG. 4 is a plan view, cross sectional view, and bottom view of a cavity body shown in FIG. 3.

FIG. 4 shows a plan view of the cavity body 10, a cross sectional view of the cavity body 10, and a bottom view of the cavity body 10 in this order from the top. As shown in FIG. 4, the cavity body 10 has a hole 16.

The hole 16 has an upper part 18, a lower part 20, and a bump surface 22. A side surface 24 of the cavity body 10 is a cylindrical surface. The hole 16 extends through the cavity body 10. The hole 16 may not extend through the cavity body 10.

A sectional shape (see the plan view of FIG. 4) of the upper part 18 is substantially equal to a sectional shape of an engaging part 32 of the weight 12. In the embodiment, the upper part 18 and the engaging part 32 have an approximately square sectional shape. A length L1 of the lower part 20 is substantially equal to a length L11 of the engaging part 32 of the weight 12.

A material of the cavity body 10 is a polymer. The polymer is hard. The polymer can be elastically deformed when the weight 12 is detached/attached. The detaching/attaching scheme will be described later. A structure of the lower part 20 of the hole 16 will be also described later.

Figure 5:
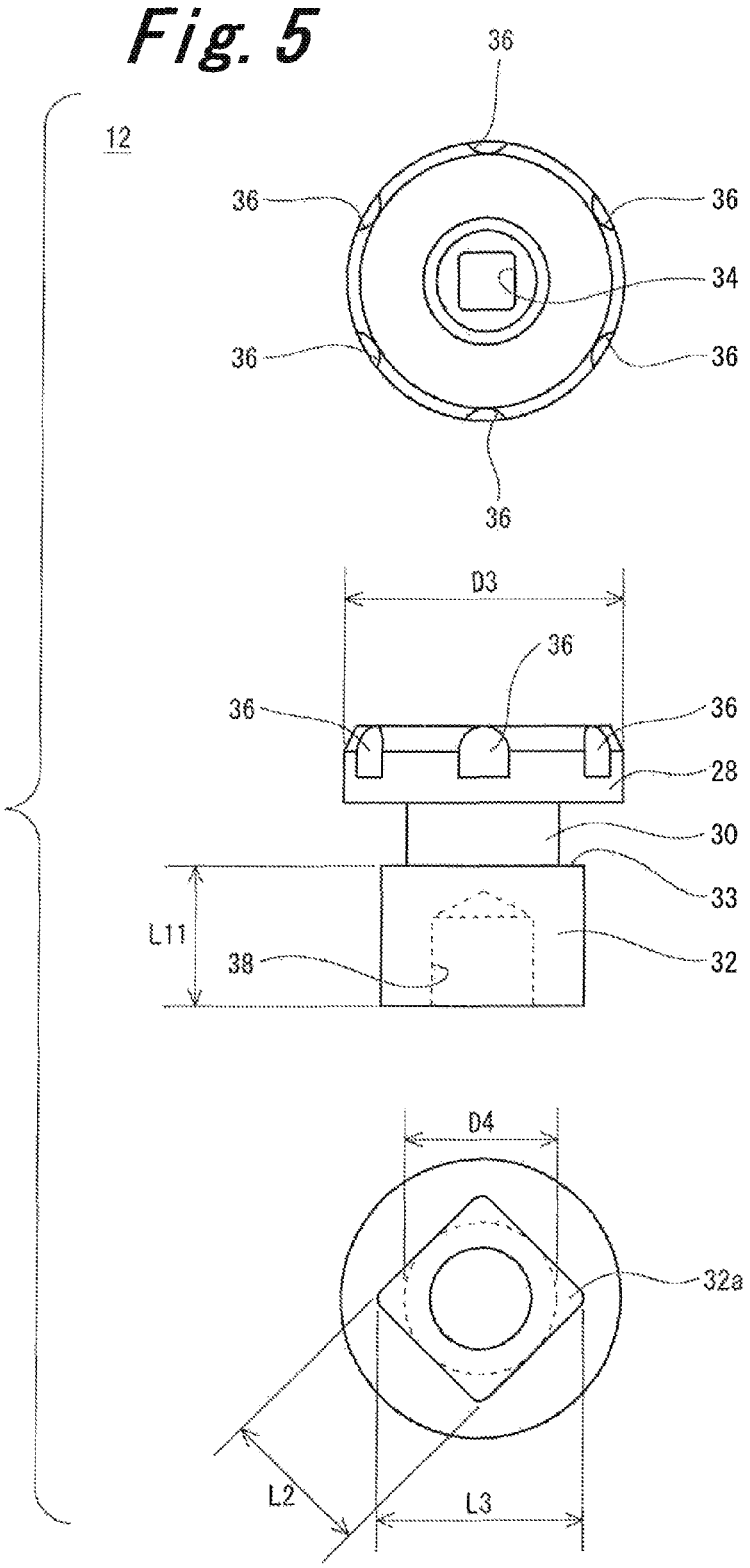
FIG. 5 is a plan view, side view, and bottom view of a weight shown in FIG. 3.

FIG. 5 shows a plan view, side view, and bottom view of the weight 12 in this order from the top. As shown in FIG. 5, the weight 12 has a head part 28, a neck part 30, and an engaging part 32. The head part 28 and the neck part 30 have an approximately cylindrical shape. A noncircular hole 34 is formed at a center of an upper end face of the head part 28. In the embodiment, a shape of the noncircular hole 39 has a quadrangle. A plurality of cutouts 36 is formed in an outer peripheral surface of the head part 28. An outer diameter D3 of the head part 28 is greater than an outer diameter D4 of the neck part.

The engaging part 32 has a noncircular section. For example, the section is an approximately square. The engaging part 32 can pass through the upper part 18 of the hole 16. Herein, the engaging part 32 is a quadrangular prism. A double-pointed arrow L2 shows a length of one side of the approximately square shaped section of the engaging part 32. A double-pointed arrow L3 shows a length of a diagonal line of the approximately square shaped section. The length L2 is made the same as the outer diameter D4 of the neck part 30. The length L3 is made greater than the outer diameter D4 of the neck part 30. The engaging part 32 has a bottomed hole 38 formed from a lower end face thereof.

The engaging part 32 has a corner part 32*a* as a protruding part. The corner part 32*a* protrudes to a radial direction of the weight 12 in the section of the engaging part 32. A protruding amount of the corner part 32*a* of the engaging part 32 in the radial direction is set to ½ of the length L3.

The engaging part 32 has an upper surface 33. The upper surface 33 is formed by a difference between the sectional shapes of the engaging part 32 and neck part 30.

A specific gravity of the weight 12 is greater than a specific gravity of the cavity body 10. In respect of durability and specific gravity, a material of the weight 12 is preferably a metal. Examples of the metal include an aluminium alloy, a titanium alloy, a tungsten alloy, and a tungsten nickel alloy.

Figure 6:
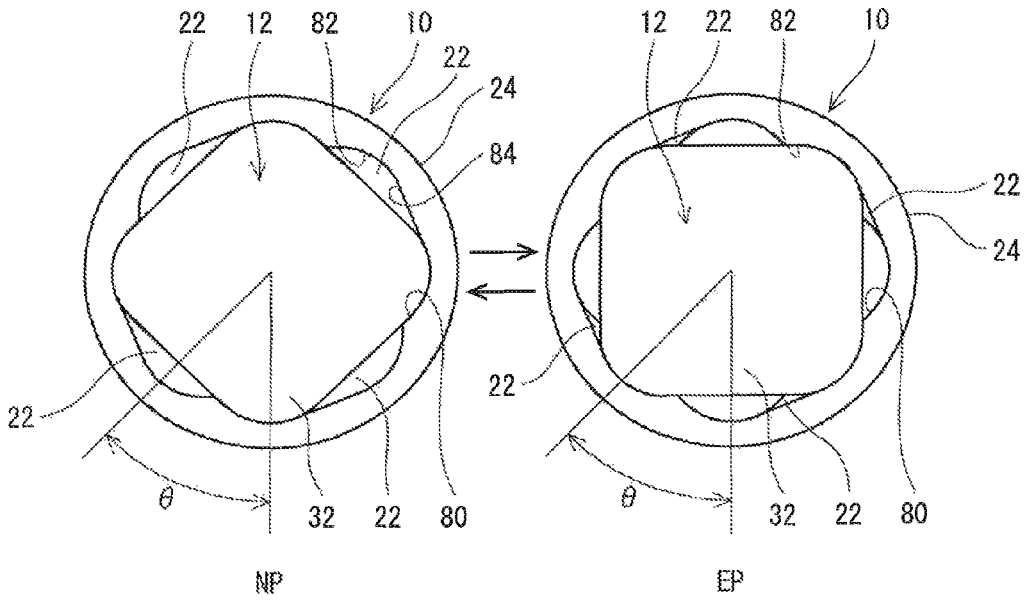
FIG. 6 is an illustration for explaining a non-engaging position NP and an engaging position EP.

FIG. 6 is a view showing a non-engaging position NP and engaging position EP of the weight attaching/detaching mechanism M1. FIG. 6 is a bottom view of a state where the weight 12 is inserted into the cavity body 10. As a relative relationship between the cavity body 10 and the weight 12, the non-engaging position NP and the engaging position EP can be taken. At the non-engaging position NP, the weight 12 can be pulled out from the cavity body 10. On the other hand, at the engaging position EP, the weight 12 cannot be pulled out from the cavity body 10. At the time of inserting the weight 12 into the cavity body 10, the relative relationship between the cavity body 10 and the weight 12 is the non-engaging position NP. The relative relationship shifts to the engaging position EP from the non-engaging position NP according to rotation of a relative angle θ. The relative relationship returns to the non-engaging position NP from the engaging position EP according to inverse rotation of the relative angle θ. In the weight attaching/detaching mechanism M1, the weight 12 can be attached/detached by merely applying the rotation of the angle θ. The weight attaching/detaching mechanism M1 has excellent easiness of attachment/detachment.

In the embodiment, the angle θ is 45 degrees. The angle θ is not restricted to 45 degrees. Examples of the angle θ include 30 degrees and 60 degrees.

A principle of the weight attaching/detaching mechanism M1 is the same as that of the grip weight attaching/detaching mechanism M2 to be described later. The principle will be described in detail in description of the grip weight attaching/detaching mechanism M2.

Figure 7:
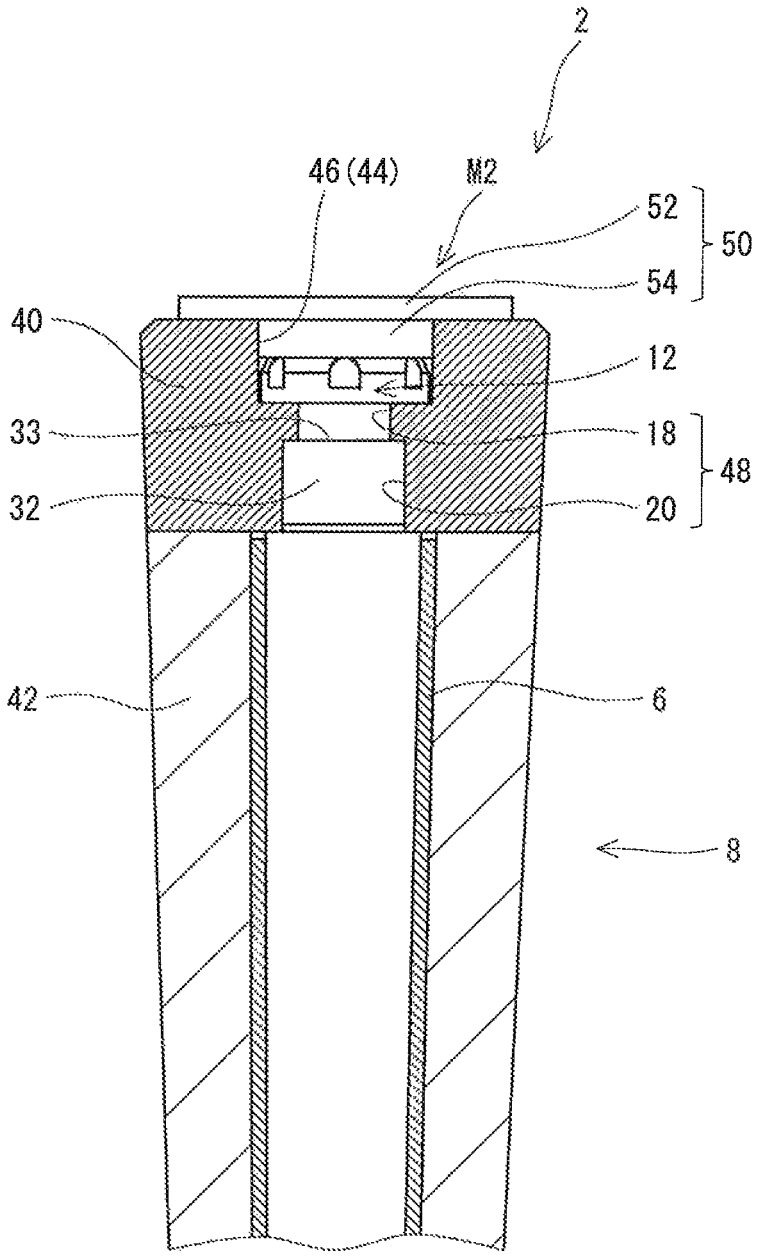
FIG. 7 is a cross sectional view of a grip end of the golf club of FIG. 1.

FIG. 7 is a cross sectional view of a vicinity of a grip end of the golf club 2. The grip weight attaching/detaching mechanism M2 has a grip cavity body 40 and a weight 12. The weight 12 is the same as the above-described weight attaching/detaching mechanism M1.

The cavity body 40 is a part of the grip 8. The cavity body 40 is integrally formed with a grip body 42. A material of the cavity body 40 is a rubber. A material of the grip body 42 is also a rubber. However, the material of the cavity body 40 is different from a material of the grip body 42. The material of the cavity body 40 is harder than the material of the grip body 42.

The cavity body 40 has a hole 44. The hole 44 has a first portion 46 and a second portion 48. The second portion 48 is located below the first portion 46. The first portion 46 can house the head part 28 of the weight 12. The second portion 48 is the same as the above-described hole 16 of the cavity body 10. Therefore, the second portion 48 has the upper part 18 and the lower part 20.

As shown in FIG. 7, the golf club 2 has a lid 50. The lid 50 has a large diameter part 52 and a small diameter part 54. The lid 50 closes the hole 44. The lid 50 can close the hole 44 in a state where the weight 12 is attached. An outer diameter of the small diameter part 54 is substantially equal to an inner diameter of the first portion 46. The small diameter part 54 is fitted into the first portion 46 of the hole 44. The lid 50 may be absent.

Figure 9:
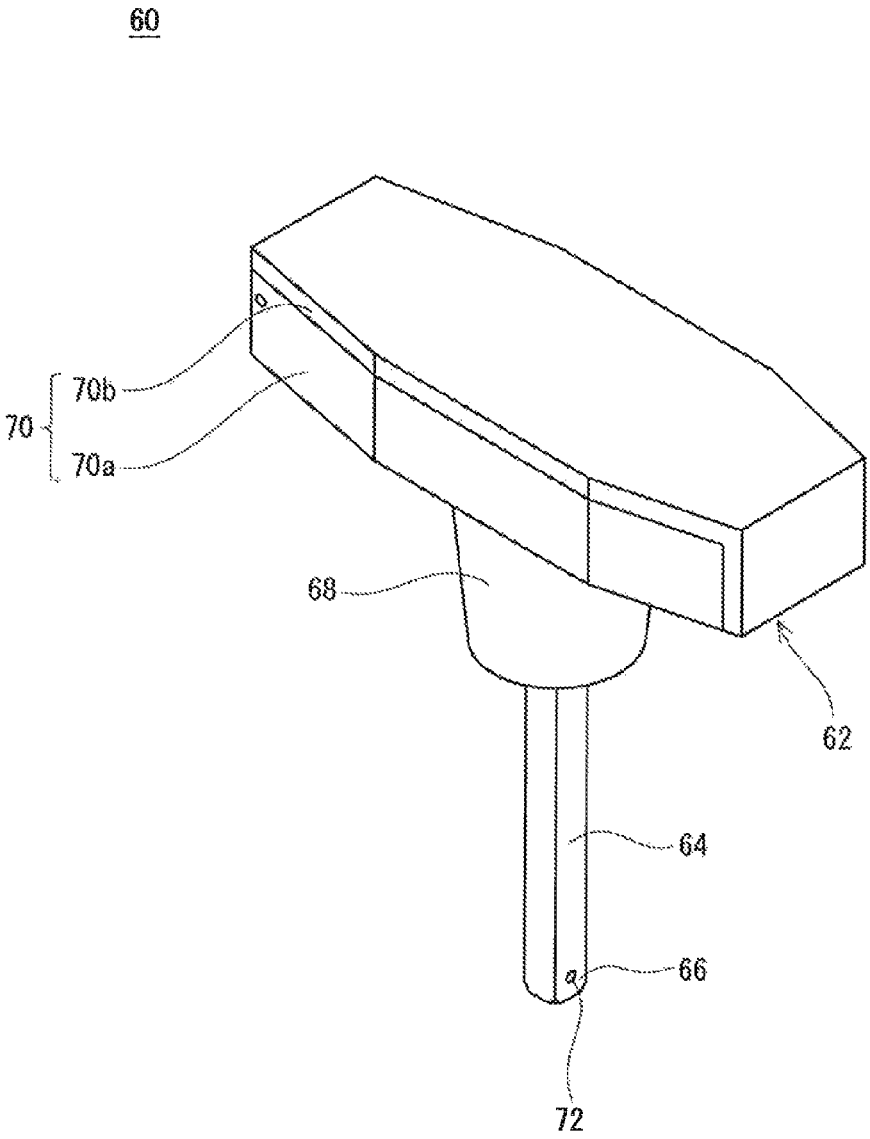
FIG. 9 is a perspective view of a tool used for attaching/detaching a weight.
Figure 10:
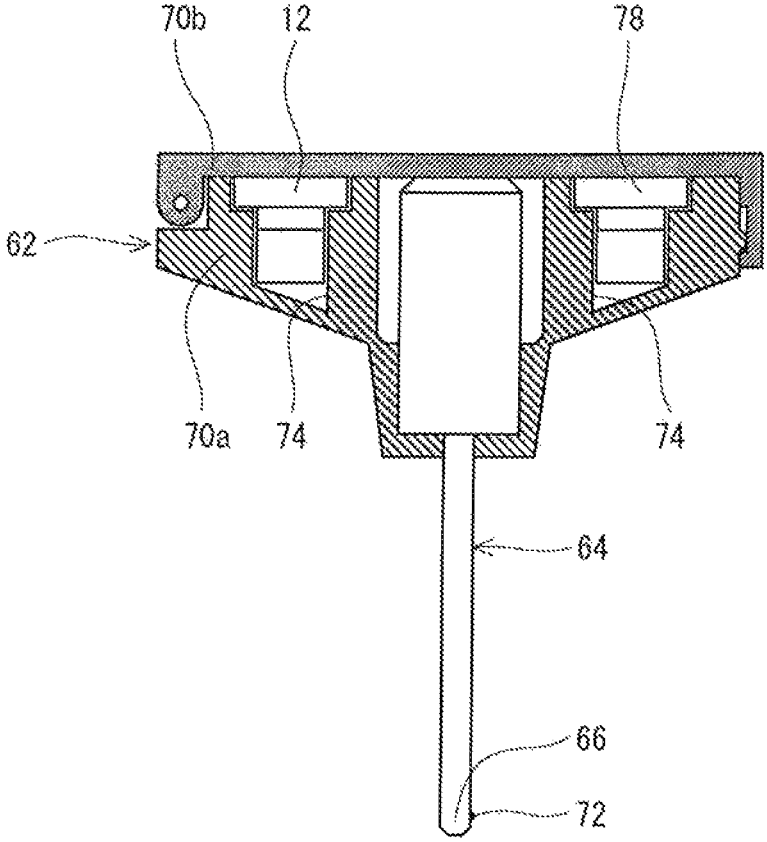
FIG. 10 is a cross sectional view of the tool of FIG. 9.

FIG. 9 is a perspective view of a tool 60. The tool 60 is used for attaching/detaching the weight 12. The tool 60 is provided with a handle 62, a shaft 64, and a tip part 66. The handle 62 has a handle body 68 and a holding part 70. The holding part 70 extends in a direction vertically crossing with a rotation axis of the tool 60 from the upper part of the handle body 68. The holding part 70 is provided with a holding body part 70*a* and a lid 70*b*.

A butt end part of the shaft 64 is fixed to the holding body part 70*a* to rotation-prevent the shaft 64. A section of the tip part 66 of the shaft 64 corresponds to a shape of the noncircular hole 34 of the weight 12. In the embodiment, the tip part 66 has a quadrangle section. A pin 72 protrudes from a side surface of the tip part 66. The pin 72 is built in the tip part 66. Although not shown in the drawings, an elastic body (coil spring) is built in the tip part 66. The pin 72 is biased in a direction protruding from the tip part 66 by an energizing force of the elastic body.

When the weight 12 is detached/attached, the lid 70*b* is closed. A plurality of (two) pockets 74 is formed in the holding body part 70*a*. The weight 12 is housed in one pocket 74. A weight 78 is housed in the other pocket 74. The weight 12 or 78 can be taken out by opening the lid 70*b*.

Both the weight 12 and the weight 78 may be used for the weight attaching/detaching mechanism M1 and the weight attaching/detaching mechanism M2. The compatibility of the attaching position enhances a degree of freedom of adjustability. Both the weight 12 and the weight 78 can be detached/attached using the tool 60. The compatibility of the tool enhances convenience of adjustment. Amass of the weight 12 is different from that of the weight 78. A plurality of weights having different masses enhances the degree of freedom of adjustability.

The number of the pockets 74 is not restricted to 2. The number may be 1, or equal to or greater than 3. The number of the weights to be housed may be 1, or equal to or greater than 3. A section of the tip part 66 corresponds to the noncircular hole 34 of the weight 12.

FIGS. 11A to 11F are illustrations for explaining attachment/detachment of the weight 12 using the tool 60.

Figure 11A:
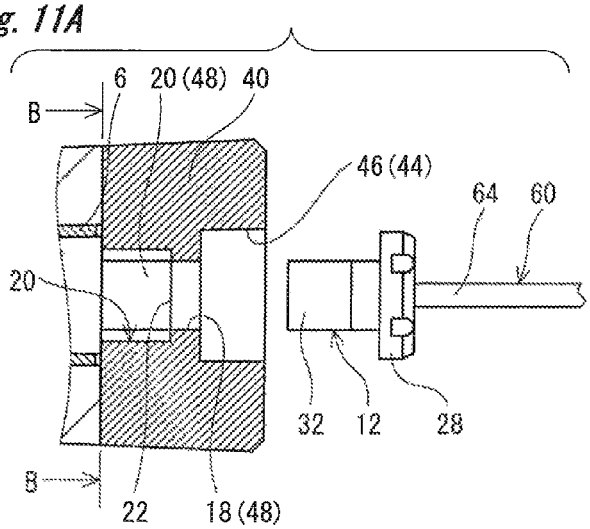
FIGS. 11A to 11F are illustrations for explaining a method for attaching the weight.

The tip part 66 of the tool 60 is inserted into the noncircular hole 34 of the weight 12 in order to attach the weight 12. The pin 72 presses the noncircular hole 34 while the pin 72 is retracted by the insertion. The weight 12 is hardly fallen off from the tip part 66 by the pressing force. As shown in FIG. 11A, the weight 12 held by the shaft 64 of the tool 60 is inserted into the hole 44.

Figure 11B:
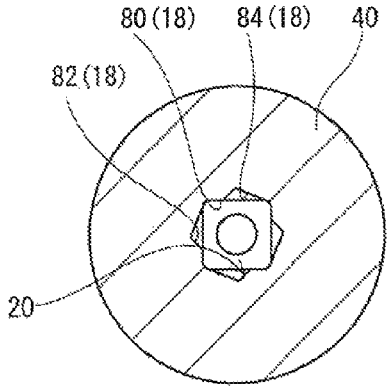
Figure 11C:
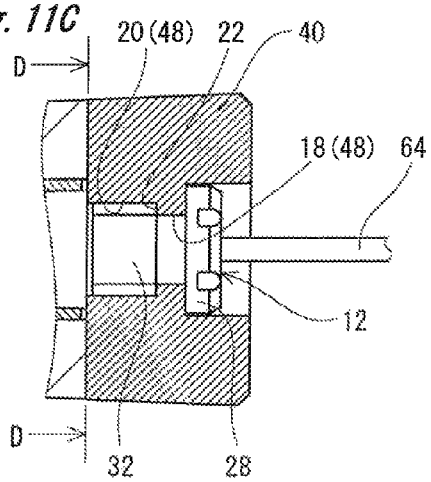
Figure 11D:
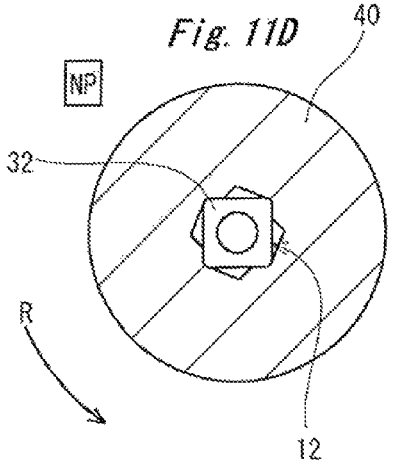

As shown in FIG. 11B, the engaging part 32 of the weight 12 passes through the upper part 18 of the second portion 98, and reaches the lower part 20. The state is the non-engaging position NP. FIG. 11D is a cross sectional view taken along line D-D of FIG. 11C, and shows the non-engaging position NP. The weight 12 can be pulled out from the hole 44 at the non-engaging position NP.

Figure 11E:
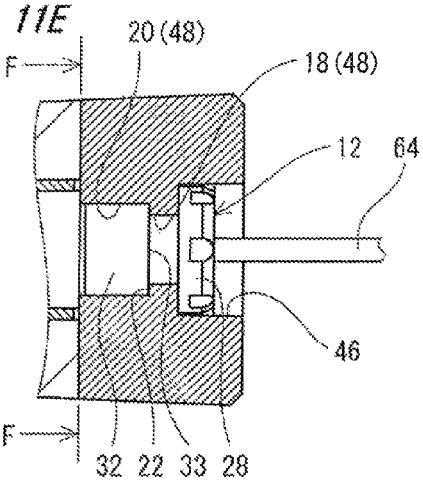
Figure 11F:
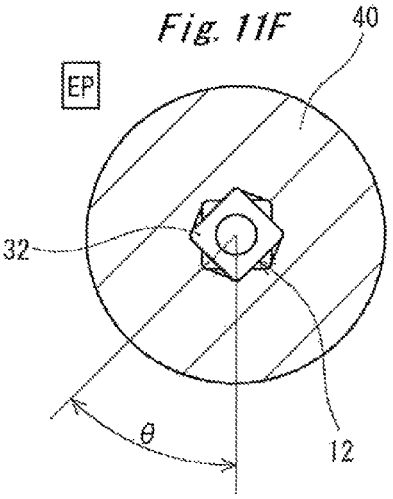

Next, the relative rotation of the angle θ is performed. Specifically, the weight 12 is rotated relative to the cavity body 40 by the angle θ using the tool 60. The shift to the engaging position EP from the non-engaging position NP is achieved by the rotation. FIGS. 11E and 11F show the engaging position EP. FIG. 11F is a cross sectional view taken along line F-F of FIG. 11E. The shift to the non-engaging position NP from the engaging position EP is achieved by inverse rotation of the relative angle θ.

At the engaging position EP, the weight 12 cannot be pulled out from the hole 49. This is because pulling out of the weight 12 is prevented by engagement between the bump surface 22 of the hole 94 and the upper surface 33 of weight 12 at the engaging position EP. Therefore, at the engaging position EP, the tool 60 can be easily pulled out from the noncircular hole 34 of the weight 12.

As shown in FIG. 11B, the lower part 20 of the hole 44 has a surface 80 corresponding to the engaging part 32 at the non-engaging position NP, a surface 82 corresponding to the engaging part 32 at the engaging position EP, and a resistance surface 84. The resistance surface 84 is pressed by the engaging part 32 during the relative rotation between the non-engaging position NP and the engaging position EP. A frictional force is generated between the engaging part 32 and the lower part 20 by the pressing. The resistance surface 84 is elastically deformed by the pressing. The material of the lower part 20 is a hard polymer, and thereby the frictional force is increased. The increased frictional force produces a strong rotation resistance. A strong torque is required for a mutual shift between the non-engaging position NP and the engaging position EP by the rotation resistance. Therefore, the tool 60 is required for the mutual shift. The mutual shift cannot be achieved with bare hands without using the tool 60.

The principle of the above-described head weight attaching/detaching mechanism M1 is also the same as that of the grip weight attaching/detaching mechanism M2.

Thus, in the head weight attaching/detaching mechanism M1 and the grip weight attaching/detaching mechanism M2, the weight can be attached/detached by merely performing the relative rotation of the angle θ.

The attaching/detaching mechanisms M1 and the attaching/detaching mechanism M2 are exemplary, and the present invention is not restricted thereto. For example, the attaching/detaching mechanism may be a so-called BNC connector type attaching/detaching mechanism. The attaching/detaching mechanism may be a screw mechanism. For example, the cavity body may have a female screw, and the weight may have a male screw. A screw of the screw mechanism, may be a usual screw or a double-thread screw. The weight may have a tubular portion into which a weight member can be put.

Figure 12:
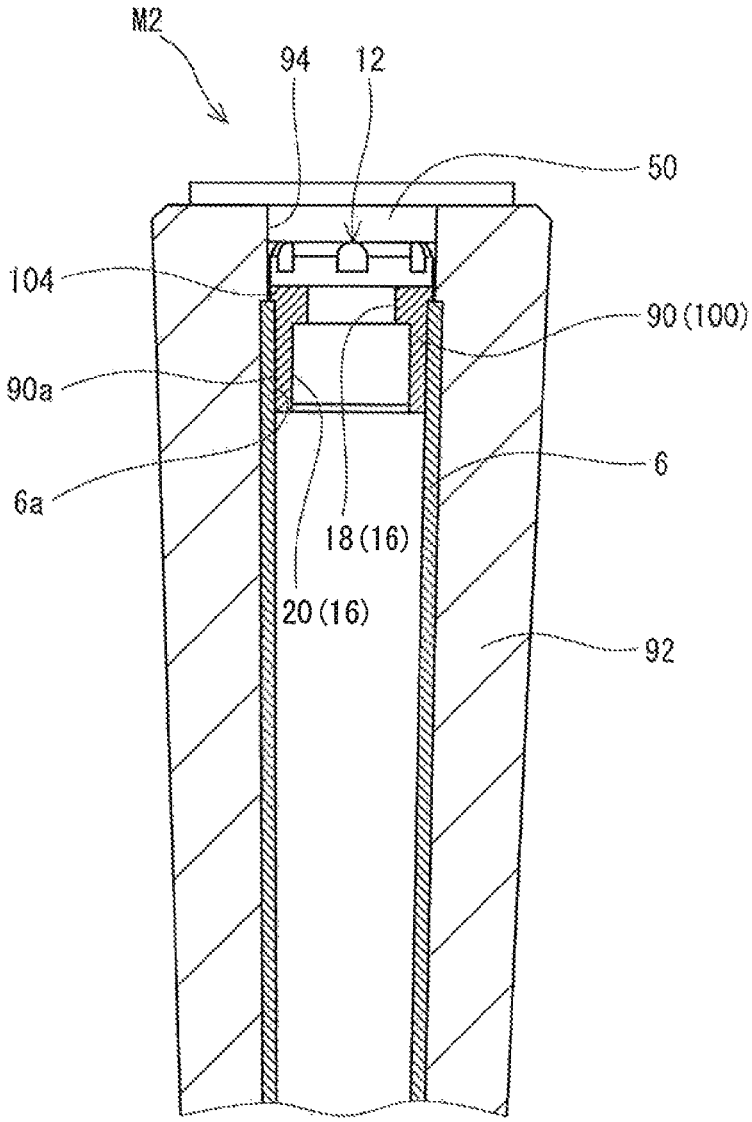
FIG. 12 is a cross sectional view of a vicinity of a grip end of a club according to another embodiment.
Figure 13:
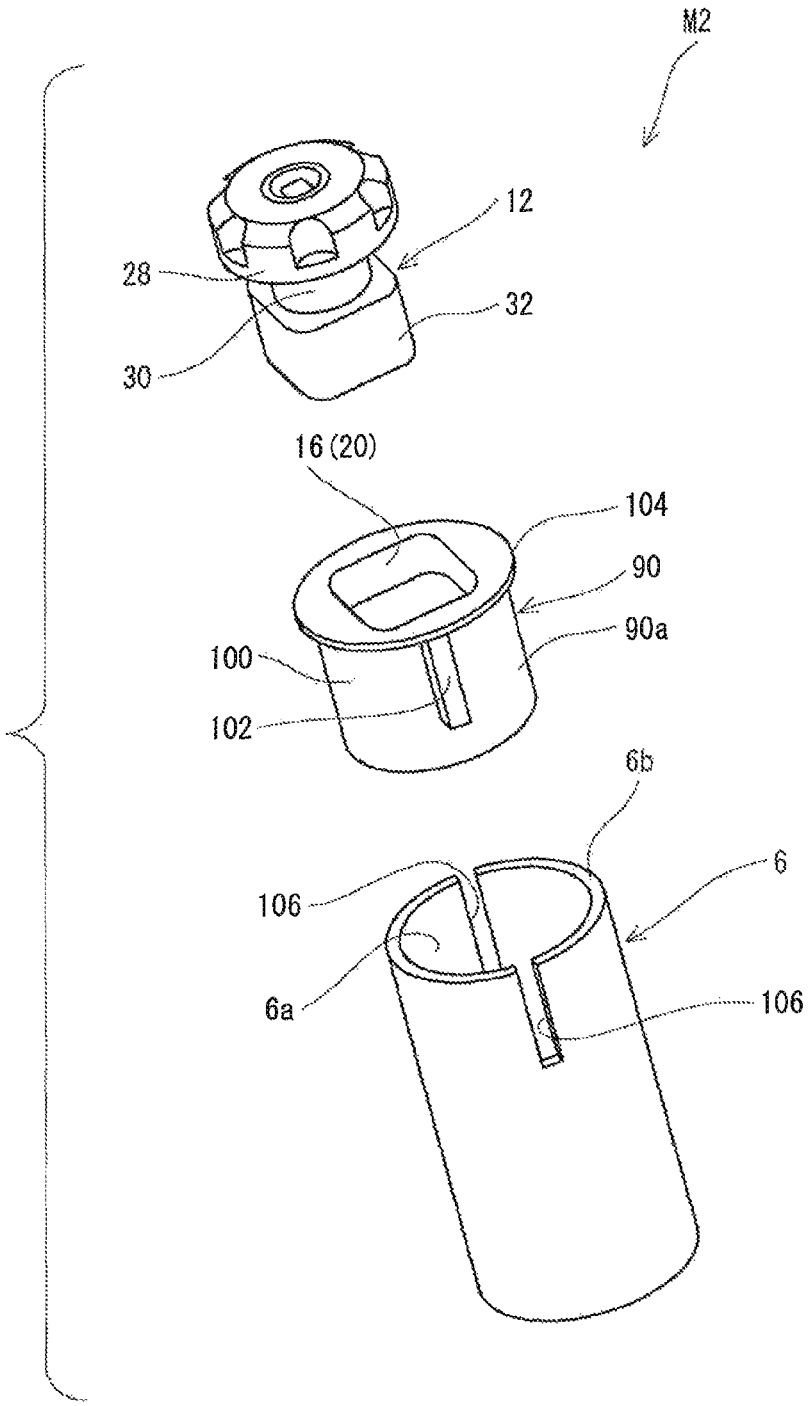
FIG. 13 is an exploded perspective view of a grip weight attaching/detaching mechanism shown in FIG. 12.

FIG. 12 is a cross sectional view of a weight attaching/detaching mechanism M2 according to another embodiment. FIG. 13 is an exploded perspective view of the weight attaching/detaching mechanism M2.

In the above-described embodiment of FIG. 7, the cavity body 40 is integrally formed with the grip. In the embodiment, a cavity body 90 is mounted to the shaft 6. The cavity body 90 is mounted to a butt end part of the shaft 6. A hole 94 into which a weight 12 is inserted is formed in a butt of a grip 92. A lid 50 is provided to close the hole 94. The lid 50 is the same as that of the above-described embodiment of FIG. 7.

The cavity body 90 has a body 100, convex parts 102, and a flange 104. The body 100 has a hole 16. The body 100 is the same as the cavity body 10 in the embodiment of FIG. 3. The hole 16 is the same as that in the embodiment of FIG. 3.

Figure 8:
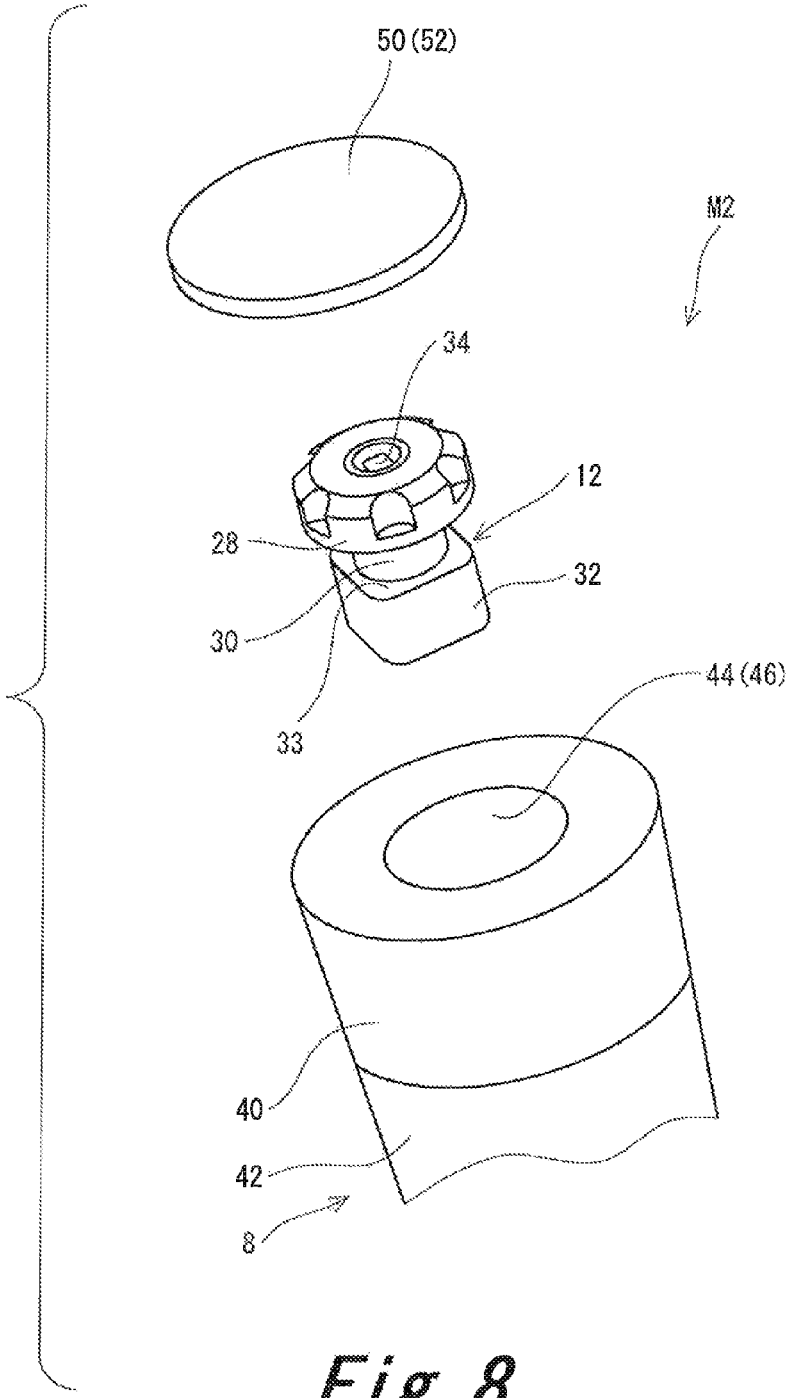
FIG. 8 is an exploded perspective view of a grip weight attaching/detaching mechanism shown in FIG. 7.

The weight 12 is the same as those of the embodiments of FIGS. 3 and 8.

An outer peripheral surface 90*a* of the cavity body 90 abuts on an inner surface 6*a* of the shaft 6. The outer peripheral surface 90*a* is bonded to the inner surface 6*a*. The convex parts 102 are inserted into slits 106 of the shaft 6, to function as a rotation stopper of the cavity body 90. A bottom surface of the flange 104 abuts on an end face 6*b* of the shaft 6. The grip weight attaching/detaching mechanism M2 of the present invention enables such an embodiment.

Figure 14:
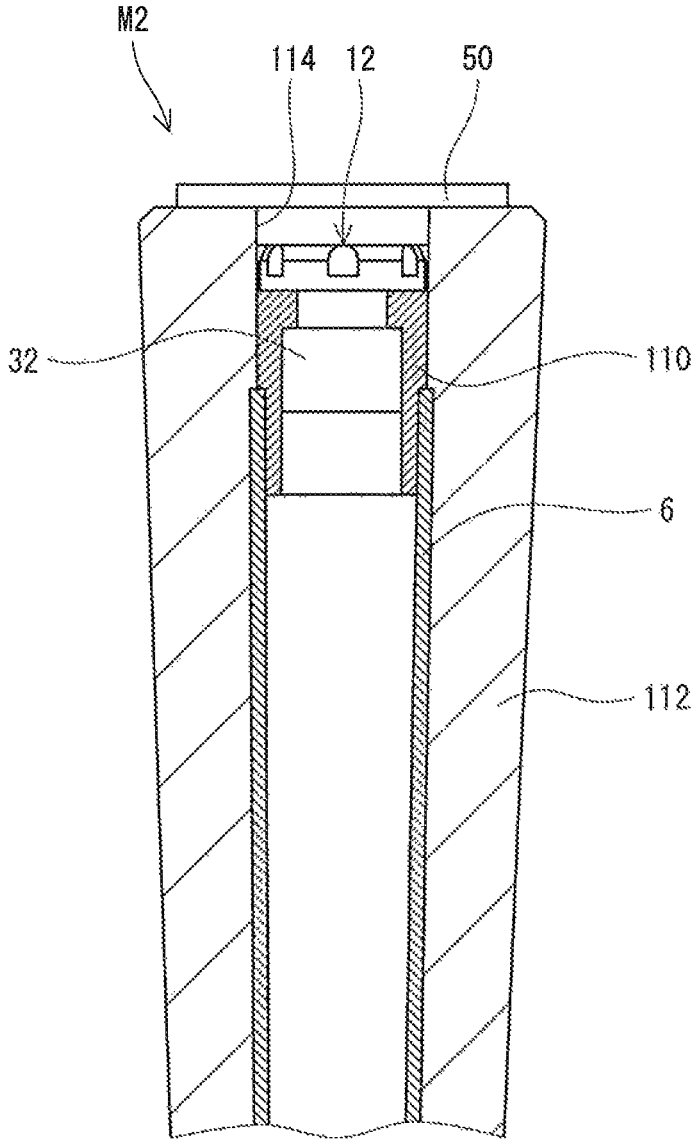
FIG. 14 is a cross sectional view of a vicinity of a grip end of a club according to still another embodiment.

A modification of the grip weight attaching/detaching mechanism M2 of FIG. 12 is shown in FIG. 14. The modification is the same as the embodiment of FIG. 12 except that the cavity body 90 is changed to a cavity body 110 and a hole 114 of a grip 112 is lengthened.

In the embodiment, a mass of the cavity body 110 is increased by lengthening the cavity body 110. Thus, the mass can be also adjusted by a volume of the cavity body 110.

An embodiment in which the cavity body 90 is attached to a grip (grip end part or the like) can be also used as another modification.

Figure 15C:
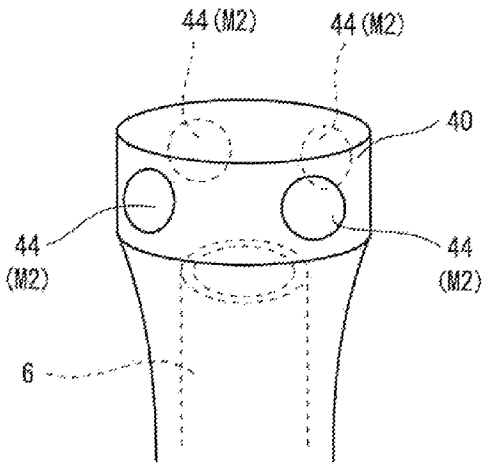
FIGS. 15A to 15C are perspective views of a vicinity of a grip end of a club according to yet still another embodiment.
Figure 15B:
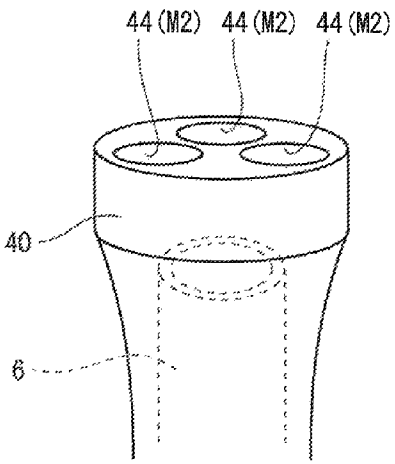
Figure 15A:
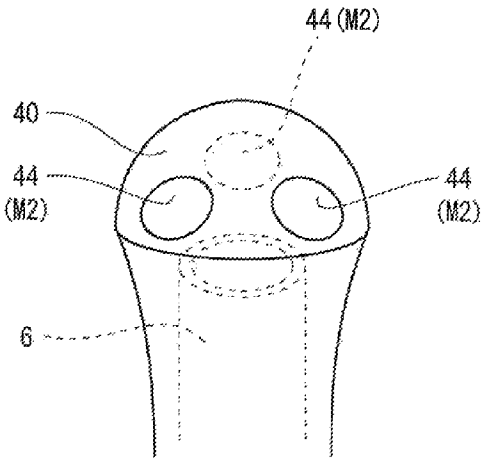

FIGS. 15A to 15C are modifications of the embodiment of FIG. 7. A plurality of holes 44 is formed in the three embodiments shown in FIGS. 15A to 15C. The cavity body 40 has the plurality of holes 44. Although not shown in the drawings, the weight 12 is attached to each of the plurality of holes 44. In the embodiments of FIGS. 15A to 15C, the plurality of weights 12 can be attached.

When the weight 12 is added to the head and the grip without changing a club balance, a mass of the weight 12 added to the grip is greater than a mass of the weight 12 added to the head. The plurality of grip weight attaching/detaching mechanisms M2 is useful for adding a mass greater than that of the head to the grip. The plurality of grip weight attaching/detaching mechanisms M2 enlarges a mass adjusting range due to the weight 12. The plurality of grip weight attaching/detaching mechanisms M2 is provided, to further improve the degree of freedom of adjustability.

The plurality of grip weight attaching/detaching mechanisms M2 is provided, and thereby the attaching number of the weights 12 can be adjusted by one kind of weight 12. For example, when the number of the grip weight attaching/detaching mechanisms M2 is 3, the attaching number of the weights 12 can be selected from four kinds of 0, 1, 2, and 3. Thereby, the degree of freedom of adjustability is further improved.

Since the head weight attaching/detaching mechanism M1 and the grip weight attaching/detaching mechanism M2 are provided in the present invention, the degree of freedom of adjustability is high. Examples of adjustments capable of being achieved by the present invention include the following mechanisms. As shown in these examples, various adjustments are possible. The weights 12 are preferably prepared so that at least one of these adjustments can be achieved. The weights 12 are more preferably prepared so that two or more of these adjustments can be achieved. The weights 12 are still more preferably prepared so that all of these adjustments can be achieved.

(adjustment 1) a club mass is increased without substantially changing a club balance;

(adjustment 2) a club mass is decreased without substantially changing a club balance;

(adjustment 3) a club mass is increased while a club balance is made light;

(adjustment 4) a club mass is decreased while a club balance is made heavy;

(adjustment 5) a club balance is made heavy without substantially changing a club mass; and (adjustment 6) a club balance is made light without substantially changing a club mass.

Examples for still further enhancing adjustability include the following constitutions:

(constitution 1) the golf club has the plurality of weights 12 having different masses;

(constitution 2) the weight 12 can be used in both the head weight attaching/detaching mechanism M1 and the grip weight attaching/detaching mechanism M2. That is, the head weight is attachable to/detachable from the grip cavity body, and the grip weight is attachable to/detachable from the head cavity body;

(constitution 3) the number of the head weight attaching/detaching mechanisms M1 is plural;

(constitution 4) the number of the grip weight attaching/detaching mechanisms M2 is plural; and (constitution 5) the number of the head weight attaching/detaching mechanisms M1 is plural, and the number of the grip weight attaching/detaching mechanisms M2 is plural.

In the above-described adjustments 1 and 2, the term "without substantially changing" means that the change of the club balance (14-inch type) is equal to or less than ±1.0 point. In the adjustments 4 and 5, the term "without substantially changing" means that the change of the club mass is equal to or less than ±2 g.

The number N1 of the attaching/detaching mechanisms M1 is not restricted. In respect of the degree of freedom of adjustability, the number N1 is preferably equal to or greater than 2. The number N2 of the attaching/detaching mechanisms M2 is not restricted. In respect of the degree of freedom of adjustability, the number N2 is preferably equal to or greater than 2. In respect of enabling adjustment so that the club balance is not substantially changed, the number N2 is preferably greater than the number N1. In respect of the degree of freedom of adjustability, the number of the weights is preferably equal to or greater than (N1+N2).

Examples of the constitution of the weight for still further enhancing the adjustability include the following constitutions:

(constitution A) the head weight and the grip weight are common weights;

(constitution B) the golf club has a plurality of common weights;

(constitution C) the number of the common weights is equal to or greater than the total (N1+N2) of the attaching/detaching mechanisms;

(constitution D) at least two of the plurality of common weights have different masses. More preferably, at least three of the plurality of common weights have different masses; and (constitution E) when amass of the heaviest common weight is set to m1 (g) and a mass of the lightest common weight is set to m2, a difference (m1−m2) is preferably equal to or greater than 2 g, more preferably equal to or greater than 3 g, and still more preferably equal to or greater than 4 g. In respect of avoiding an excessive club mass, the difference (m1−m2) is preferably equal to or less than 10 g.

The common weight is attachable to/detachable from both the head cavity body and the grip cavity body. The common weight can be attached/detached by a common tool.

A hardness Hc of the cavity body is not restricted. In respect of certainly fixing the weight 12, the hardness Hc is preferably equal to or greater than 60, more preferably equal to or greater than 65, and still more preferably equal to or greater than 70. In respect of easily attaching/detaching the weight 12, the hardness Hc is preferably equal to or less than 95, and more preferably equal to or less than 90.

The hardness Hc is a JIS-A hardness. The JIS-A hardness is measured by an A type Durometer under an environment of 23° C. in accordance with regulations of "JIS-K6253". Specimens formed of the material constituting the cavity body are used for the measurement.

As in the above-described embodiment, the head weight and the grip weight are preferably attached/detached by the same tool 60. The convenience of attachment/detachment and adjustment is improved by making the tool 60 common.

As in the embodiment of FIG. 7, when the cavity body 40 is integrally formed with the grip body 42, a hardness Hg of the grip body 42 is preferably less than the hardness Hc of the cavity body 40. In respect of easiness of holding, the hardness Hg is preferably less than 60, more preferably equal to or less than 55, and still more preferably equal to or less than 50. In respect of stability of swing, the hardness Hg is preferably equal to or greater than 40. The hardness Hg is also the JIS-A hardness as well as the hardness Hc.

The material of the grip body is not restricted. In respect of easiness of holding, the material of the grip body is preferably a rubber composition. Preferable examples of a base material rubber of the rubber composition include a natural rubber, a styrene-butadiene rubber (SBR), an ethylene propylene diene rubber (EPDM), an isoprene rubber, and a mixture thereof. In respect of moldability, the styrene-butadiene rubber (SBR) and the ethylene propylene diene rubber (EPDM) are more preferable.

When the golf player hits a ball using the golf club 2, hitting vibration is transmitted to the golf player's hands via the golf club 2. Vibration energy of the hitting vibration is converted into kinetic energy of the weight 12 housed in the cavity body. The cavity body and the weight 12 convert the vibration energy of the shaft 6 into the kinetic energy of the weight 12 to alleviate the hitting vibration.

The polymer of the cavity body 10 is preferably a resin or a rubber. In respect of processability, a thermoplastic resin and a fiber-reinforced resin thereof are preferable. Examples of the resin include polyurethane, a polyether block copolymer, and polycarbonate. On the other hand, the polymer of the cavity body 40 when the cavity body 40 is integrally formed with the grip is preferably a rubber.

In respect of certainly fixing the weight, a complex elastic modulus of a resin of the cavity body is preferably equal to or greater than $1.0\times10^8$ dyn/cm$^2$, and more preferably equal to or greater than $5.0\times10^8$ dyn/cm$^2$. In respect of vibration absorptivity, the complex elastic modulus is preferably equal to or less than $1.0\times10^{10}$ dyn/cm$^2$, and more preferably equal to or less than $5.0\times10^9$ dyn/cm$^2$.

Examples of the material having a complex elastic modulus include "Himilan 1605" (trade name) manufactured by DUPONT-MITSUI POLYCHEMICALS CO., LTD, "Pebax 5533" (trade name) manufactured by ARKEMA, and "RILSAN-BMNO" (11-Nylon) (trade name) manufactured by ARKEMA.

The complex elastic modulus can be measured using a viscoelastic measuring apparatus (viscoelastic spectrometer DVA200 advanced model manufactured by SHIMADZU CORPORATION). The measurement conditions are as follows.

a dimension of a specimen: a width of 4.0 mm, a thickness of 2.0 mm, and a length of 30.0 mm a length dimension in a displaced portion: 20.0 mm (lengths of 5.0 mm from both ends in the length of 30.0 mm are held)

a frequency: 10 Hz a temperature rising speed: 2° C./min an initial strain: 2 mm a displacing amplitude width: ±12.5 μm a measurement temperature: 5° C.

When the cavity body is integrally formed with the grip, the material of the cavity body is preferably different from that of the grip body. The vibration energies having different frequencies can be absorbed by combining the different polymers. In this case, the vibration absorptivity can be improved. In respect of absorbing vibrations having different frequencies, the complex elastic modulus of the cavity body is preferably greater than that of the grip body.

The complex elastic modulus of the head cavity body may be different from that of the grip cavity body. Also in this case, the vibration energies having different frequencies can be effectively absorbed. The vibration energies having high frequencies are absorbed by the head, and the vibration energies having low frequencies are absorbed by the grip. Thereby, the vibration absorptivity can be increased. In this respect, the complex elastic modulus of the head cavity body is preferably greater than that of the grip cavity body.

EXAMPLES

Hereinafter, the effects of the present invention will be clarified by examples. However, the present invention should not be interpreted in a limited way based on the description of the examples.

Example 1

"SRIXON Z-TX2 Driver Loft 10.5 degrees" (trade name) manufactured by SRI Sports Limited was used as a base club. A head and grip of the base club were revised. The above-described two holes 14 were formed in the head. The above-described cavity body 10 was attached to each of the holes 14. A grip shown in FIG. 7 was produced. In the production of the grip, an end material constituting the cavity body 40 was produced by a first rubber composition, and a body material constituting the grip body 42 was produced by a second rubber composition. The unvulcanized end material was put into a grip metal mold. Furthermore, the unvulcanized body material was put into the grip metal mold, and the metal mold was closed. A split mold for forming a hole 44 was disposed in the end material. The materials were vulcanized by heating and pressurizing, and the split mold was then removed, to obtain a grip integrally formed with a cavity. A standard grip of the base club is changed to the grip integrally formed with the cavity, to obtain a golf club according to example 1. A plurality of weights 12 capable of being attached to the head and the grip and a tool 60 for attaching/detaching the weights 12 were prepared. The plurality of weights 12 having different masses was prepared.

The weights 12 were attached to the head and the grip, to obtain a golf club of example 1.

Example 2

The weights 12 of example 1 were attached/detached or changed, to obtain a club of example 2. The club of example 2 had the same club balance as that of example 1 and a club mass lighter by 9 g than that of example 1.

Example 3

The weights 12 of example 1 were attached/detached or changed, to obtain a club of example 3. The club of example 3 had the same club balance as that of example 1 and a club mass heavier by 9 g than that of example 1.

Example 4

The weights 12 of example 1 were attached/detached or changed, to obtain a club of example 4. The club of example 4 had a club balance lighter by two points than that of example 1 and the same club mass as that of example 1.

Example 5

The weights 12 of example 1 were attached/detached or changed, to obtain a club of example 5. The club of example 5 had a club balance heavier by two points than that of example 1 and the same club mass as that of example 1.

Comparative Example 1

A golf club of comparative example 1 was produced in the same manner as in example 1 except that the grip integrally formed with the cavity was changed to the standard grip. In comparative example 1, only a head has a weight attaching/detaching mechanism. The weight 12 was adjusted so that a club balance and a club mass were the same as those of example 1, to obtain a club of comparative example 1.

Comparative Example 2

The weight 12 of comparative example 1 was attached/detached or changed, to obtain a club of comparative example 2. The club of comparative example 2 had a head weight mass lighter by 10 g than that of comparative example 1. As a result, a club balance of the club of comparative example 2 was lighter than that of comparative example 1.

Comparative Example 3

The weight 12 of comparative example 1 was attached/detached or changed, to obtain a club of comparative example 3. The club of comparative example 3 had a head weight mass heavier by 10 g than that of comparative example 1. As a result, a club balance of the club of comparative example 3 was heavier than that of comparative example 1.

Comparative Example 4

A golf club of comparative example 4 was produced in the same manner as in example 1 except that the above-described head weight attaching/detaching mechanism M1 was removed. In comparative example 4, only a grip has a weight attaching/detaching mechanism. The weight 12 was adjusted so that a club balance and a club mass were the same as those of example 1, to obtain a club of comparative example 4.

Comparative Example 5

The weight 12 of comparative example 4 was attached/detached or changed, to obtain a club of comparative example 5. The club of comparative example 5 had a grip weight mass lighter by 10 g than that of comparative example 4. As a result, a club balance of the club of comparative example 5 was heavier than that of comparative example 4.

Comparative Example 6

The weight 12 of comparative example 4 was attached/detached or changed, to obtain a club of comparative example 6. The club of comparative example 6 had a grip weight mass heavier by 10 g than that of comparative example 4. As a result, a club balance of the club of comparative example 6 was lighter than that of comparative example 4.

[Evaluation]

Valuation methods are as follows.

[Measurement of Swing Weight (Club Balance)]

A swing weight was measured by using "BANCER-14" (trade name) manufactured by DAININ Corporation. The swing weight is a 14-inch type. The measured values are shown in the following Table 1.

[Sensuous Evaluations of Easiness of Swing]

Four golf players shown in Table 2 evaluated. Each of the golf players hit five balls using each of the clubs. Each of the golf players conducted sensuous evaluation of each of the clubs in terms of easiness of swing at five stages of a scale of one to five. A club thought to tend to be swung provides a higher score. The scores are shown in the following Table 1.

[Selection of Club to be Swung Most Easily]

The four golf players selected clubs to be swung most easily. The selected clubs are shown in the following Table 1.

TABLE 1

Specifications and evaluation results of examples and comparative examples

| | | Comparative Example 1 | Comparative Example 2 | Comparative Example 3 | Comparative Example 4 | Comparative Example 5 | Comparative Example 6 | Example 1 | Example 2 | Example 3 | Example 4 | Example 5 | Selected club |
|---|---|---|---|---|---|---|---|---|---|---|---|---|---|
| Mass of weight material [g] | Head | 12 | 2 | 22 | | | | 12 | 9 | 15 | 9 | 15 | |
| | Grip end | | | | 15 | 5 | 25 | 15 | 9 | 21 | 18 | 12 | |
| | Total | 12 | 2 | 22 | 15 | 5 | 25 | 27 | 18 | 36 | 27 | 27 | |
| Club mass [g] | | 300 | 290 | 310 | 300 | 290 | 310 | 300 | 291 | 309 | 300 | 300 | |
| Club balance | | D2 | C7 | D7 | D2 | D4 | D0 | D2 | D2 | D2 | D0 | D4 | |
| Easiness of swing (evaluations at five stages) | Tester A | 2 | 3 | 1 | 2 | 3 | 2 | 2 | 4 | 1 | 3 | 2 | Example 2 |
| | Tester B | 3 | 1 | 3 | 3 | 2 | 4 | 3 | 1 | 5 | 3 | 3 | Example 3 |
| | Tester C | 3 | 3 | 2 | 3 | 4 | 2 | 3 | 3 | 2 | 5 | 2 | Example 4 |
| | Tester D | 2 | 1 | 3 | 2 | 1 | 3 | 2 | 2 | 3 | 2 | 4 | Example 5 |

TABLE 2

| List of testers | | | |
|---|---|---|---|
| | Age | Average score | Feature |
| Tester A | 63 | 89 | A tester A has been a golf player for 36 years. The tester A increases the number of times of rounds after retirement upon age, to favorably improve his score. However, the tester A burns low with age, and recently feels that the tester A wants to reduce a club weight. |
| Tester B | 29 | 98 | A tester B has been a golf player for 3 years. The tester B goes to a golf practice range once a week and plays a round of golf once a month, to soon get skillful. Since the tester B improves muscle strength and improves a good swing balance, the tester B finds a club light recently. |
| Tester C | 55 | 82 | A tester C has been a golf player for 30 years. The tester C plays a round of golf on the member golf course twice or thrice a month. The tester C diligently alters a swing, and recently tries to change his swing to a swing for turning a head using cock of wrists. However, the tester C feels that heads of clubs to be used are heavy, and the heads cannot be easily turned. |
| Tester D | 43 | 111 | A tester D has been a golf player for 15 years. Usually, the tester D seldom goes to a golf practice range, and plays a round of golf when the tester D is invited. The tester D is not cured of an old habit of top hitting, and does not find the golf interesting. |

A tester A selected example 2 as the club to be swung most easily. The reason for the selection was that the club of example 2 had a light club mass to reduce burdens on a body during swing although the club of example 2 had the same club balance as that of example 1.

A tester B selected example 3 as the club to be swung most easily. The reason for the selection was that the club of example 3 had a heavy club mass to produce a stabilized swing although the club of example 3 had the same club balance as that of example 1.

A tester C selected example 4 as the club to be swung most easily. The reason for the selection was that the club of example 4 has a light club balance to produce easy head operation although the club of example 4 had the same club mass as that of example 1.

A tester D selected example 5 as the club to be swung most easily. The reason for the selection was that example 5 had a heavy club balance to decrease a misshot of a top although the club of example 5 had the same club mass as that of example 1.

The golf clubs of examples 1 to 5 are the same golf clubs. Examples 1 to 5 are produced by merely adjusting the weight. The golf clubs could be adjusted so as to be suitable for the four testers by adjusting the weight. Examples had an excellent degree of freedom of adjustment.

As shown in Table 1, examples are highly evaluated as compared with comparative examples. From the evaluation results, the advantages of the present invention are apparent.

The invention described above can be applied to all golf clubs. The present invention can be used for a wood type golf club, a utility type club, a hybrid type club, an iron type golf club, and a putter club or the like.

The description hereinabove is merely for an illustrative example, and various modifications can be made in the scope not to depart from the principles of the present invention.

What is claimed is:

1. A golf club comprising:

a head;

a shaft;

a grip;

a head cavity body fixed to the head;

a grip cavity body mounted to the grip;

a head weight attachable to and detachable from the head cavity body; and a grip weight attachable to and detachable from the grip cavity body, wherein a material of the grip cavity body is a polymer, a material of the head cavity body is a polymer, the head cavity body is fixed to the head independent of the head weight, the head weight is attachable to and detachable from the grip cavity body, and the grip weight is attachable to and detachable from the head cavity body.

2. The golf club according to claim 1, wherein a club mass can be adjusted with a change of a club balance being equal to or less than ±1.0 point.

3. The golf club according to claim 1, further comprising one or more additional grip weights attachable to/detachable from the grip cavity body.

4. The golf club according to claim 1, wherein the head weight and the grip weight are attached/detached by a same tool.

5. The golf club according to claim 1, wherein the head weight and the grip weight can be attached/detached by relative rotation of an angle θ.

6. The golf club according to claim 1, wherein the head weight and the grip weight are prepared so that at least one of the following adjustments 1 to 6 can be achieved:

(adjustment 1) a club mass is increased with a change of a club balance being equal to or less than ±1.0 point;

(adjustment 2) a club mass is decreased with a change of a club balance being equal to or less than ±1:0 point;

(adjustment 3) a club mass is increased while a club balance is made lighter after the adjustment 3;

(adjustment 4) a club mass is decreased while a club balance is made heavier after the adjustment 4;

(adjustment 5) a club balance is made heavier after the adjustment 5 with a change of a club mass being equal to or less than ±2 g; and (adjustment 6) a club balance is made lighter after the adjustment 6 with a change of a club mass being equal to or less than ±2 g.

7. The golf club according to claim 6, wherein the head weight and the grip weight are prepared so that two or more of the adjustments 1 to 6 can be achieved.

8. The golf club according to claim 6, wherein the head weight and the grip weight are prepared so that all the adjustments 1 to 6 can be achieved.

9. The golf club according to claim 1, wherein the head weight and the grip weight are attachable to/detachable from both the head cavity body and the grip cavity body.

10. The golf club according to claim 1, wherein the head cavity body and the grip cavity body have a JIS-A hardness Hc of 60 or greater and 95 or less.

11. The golf club according to claim 1, wherein the head cavity body and the grip cavity body have a complex elastic modulus of $1.0\times10^{8}$ dyn/cm$^{2}$ or greater and $1.0\times10^{10}$ dyn/cm$^{2}$ or less.

* * * * *